US009517182B2

(12) United States Patent
Richard

(10) Patent No.: US 9,517,182 B2
(45) Date of Patent: Dec. 13, 2016

(54) MULTI FLOW MULTI VENTING NIPPLE

(71) Applicant: Dart Industries Inc., Orlando, FL (US)

(72) Inventor: Maxime R. Richard, Weston, FL (US)

(73) Assignee: Dart Industries Inc., Orlando, FL (US)

( * ) Notice: Subject to any disclaimer, the term of this patent is extended or adjusted under 35 U.S.C. 154(b) by 204 days.

(21) Appl. No.: 13/667,360

(22) Filed: Nov. 2, 2012

(65) Prior Publication Data

US 2014/0124469 A1 May 8, 2014

(51) Int. Cl.

| | |
|---|---|
| ***A61J 11/00*** | (2006.01) |
| ***A61J 11/02*** | (2006.01) |
| ***A61J 11/04*** | (2006.01) |

(52) U.S. Cl.

CPC ..... *A61J 11/001* (2013.01); *A61J 11/02* (2013.01); *A61J 11/04* (2013.01)

(58) Field of Classification Search

CPC ..... A61J 11/00; A61J 9/00; A61J 11/001; A61J 11/02; A61J 11/002

USPC ..... 215/11.5, 11.1, 11.4; 220/714

See application file for complete search history.

(56) References Cited

U.S. PATENT DOCUMENTS

| | | | | |
|---|---|---|---|---|
| 990,662 | A | 4/1911 | MacGlashan | |
| 2,434,611 | A * | 1/1948 | Hamiel | A61J 9/008 116/308 |
| 2,889,064 | A | 6/1959 | Kurkjian | |
| 3,139,064 | A * | 6/1964 | Harle | A61J 11/001 116/309 |
| 6,883,672 | B2 * | 4/2005 | Dunn et al. | 215/11.5 |
| 2012/0267334 | A1 * | 10/2012 | Yamashita | A61J 11/02 215/11.5 |
| 2013/0131588 | A1 * | 5/2013 | Silver et al. | 604/74 |
| 2013/0200031 | A1 * | 8/2013 | Rees et al. | 215/11.4 |

* cited by examiner

*Primary Examiner* — Anthony Stashick
*Assistant Examiner* — Raven Collins
(74) *Attorney, Agent, or Firm* — Taylor J. Ross

(57) ABSTRACT

A multi flow multi venting nipple includes a teat having a flow aperture which allows for at least two different flow rates depending upon the operative radial orientation of the nipple. The nipple further includes a number of vent apertures, equal to the number of flow rates, formed by check valves extending through the nipple to reduce negative pressure during use. Each vent aperture is associated with a particular flow rate, and is radially oriented to be uppermost and vertically above the flow aperture during use at such flow rate. All vent apertures will be operable at once. The nipple further includes safety walls extending from the nipple and surrounding at least half the periphery of each check valve forming the vent apertures. The safety wall prevents unintentional and rough contact from damaging the check valves.

9 Claims, 3 Drawing Sheets

MULTI FLOW MULTI VENTING NIPPLE

CROSS REFERENCE TO RELATED APPLICATIONS

Not Applicable.

STATEMENT REGARDING FEDERALLY SPONSORED RESEARCH

Not applicable.

BACKGROUND OF THE INVENTION

The present invention relates in general to feeding bottle for infants. In particular, the present invention relates to an improved nipple having variable flow rates dependent upon feeding position, combined with multiple venting valves each associated with feeding position as well as a wall protrusion protecting each venting valve.

Infant feeding bottles and their nipples are well known. One popular nipple design includes a flow aperture shaped such that the flow from the bottle will vary depending upon the radial orientation of the opening (referred to herein as the "clocking" of the nipple). With such a nipple, the user may simply rotate the bottle in their hand to a different clocking position (indicated on the nipple) to achieve a different flow rate. Nipples having a "C" shaped flow aperture permitting three different flow rates are a good example of this prior art arrangement. Additionally, it is known to provide a feeding nipple with one or more vent apertures which will allow air to flow into the bottle during feeding to relieve the buildup of negative pressure within the bottle. Despite this, there continues to be difficulty in ensuring adequate flow without negative pressure. Further, these prior art nipples are not as rugged as desired for extended use.

SUMMARY OF THE INVENTION

An object of the present invention is to provide an infant feeding nipple with multiple flow rates and adequate venting at each flow rate.

Another object of the present invention is to provide an infant feeding nipple which is rugged and will not be damaged during cleaning.

These and other objects are achieved by a multi flow multi vent feeding nipple. The nipple includes a teat portion having a flow aperture which will allow differing flow rates depending upon the radial orientation or clocking of the nipple. The nipple also includes a mounting flange. Multiple vent apertures extend through this mounting flange, and in particular one vent aperture for each flow rate. Each one of these vent apertures is located in a position so as to be uppermost in the clocking position associated with its assigned flow rate. Further, the mounting flange includes a safety wall associated with each vent aperture. Each safety wall extends downward from the mounting flange and partially surrounds its associated venting aperture. The safety wall serves to protect the fragile venting aperture during handling and cleaning.

BRIEF DESCRIPTION OF THE DRAWINGS

The objects and features of the invention noted above are explained in more detail with reference to the drawings, in which like reference numerals denote like elements, and in which.

DETAILED DESCRIPTION OF THE INVENTION

Figure 1:
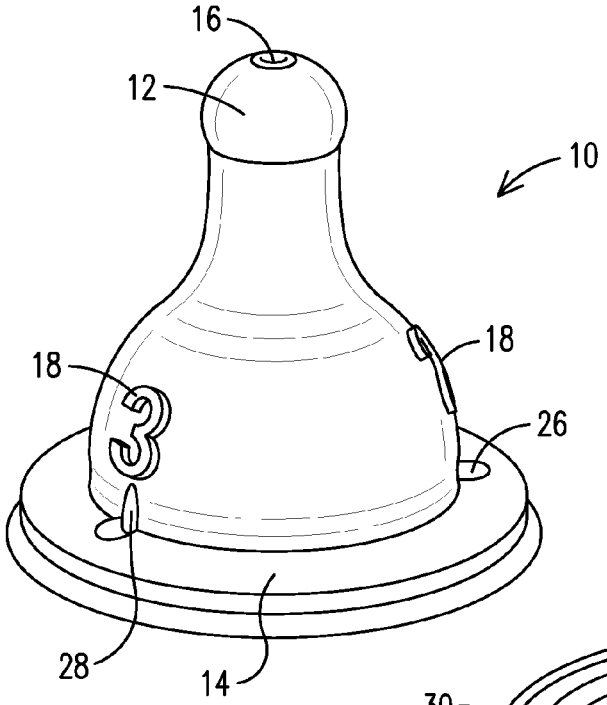
FIG. 1 is a top perspective view of a multi flow multi venting nipple according to the present invention.

With reference to FIG. 1, a multi flow multi venting nipple according to the present invention is generally designated by reference numeral 10. The nipple 10 generally includes a teat 12, sized for receipt in an infant's mouth, and a mounting flange 14. The nipple 10 will typically be formed of a soft elastomeric material such as silicone, latex or the like with the various components being a monolithic unit. The teat 12 includes a centrally located flow aperture 16. The flow aperture 16 will have one of several shapes known in the art to provide two or more flow rates depending upon the operative radial orientation of the nipple 10 (referred to herein as the "clocking"). As may be seen by comparison of FIGS. 1-3, the nipple 10 is shown to include a flow aperture 14 having a "C" shape (as is known in the prior art), and the exterior of the nipple is provided with radially spaced indicia 18. In the example shown, this indicia 18 comprises spaced numerals "1", "2", and "3". Other indicia, such as "I", "II", "III", or "A", "B", "C" or even others could be employed. The indicia may be printed or otherwise applied to the nipple 10, but is preferably molded therein.

Each indicia 18 is located on the nipple 10 in a radially spaced location about the periphery of the nipple so as to correspond with one of the different flow rates provided by the flow aperture 16. As is known in the art, the "C" shaped flow aperture 16 would provide three flow rates associated with three radial orientations or clockings during use, and each of the three indicia 18 are located on the nipple 10 to indicate these orientations to the user by being in an uppermost vertical position relative to the infant's mouth when the nipple 10 is in use. It is of course possible to use other flow aperture shapes providing a different number of flow rates, so long as two or more flow rates are associated with a like number of radial clocking orientations, and these orientations are somehow apparent to the user.

Figure 8:
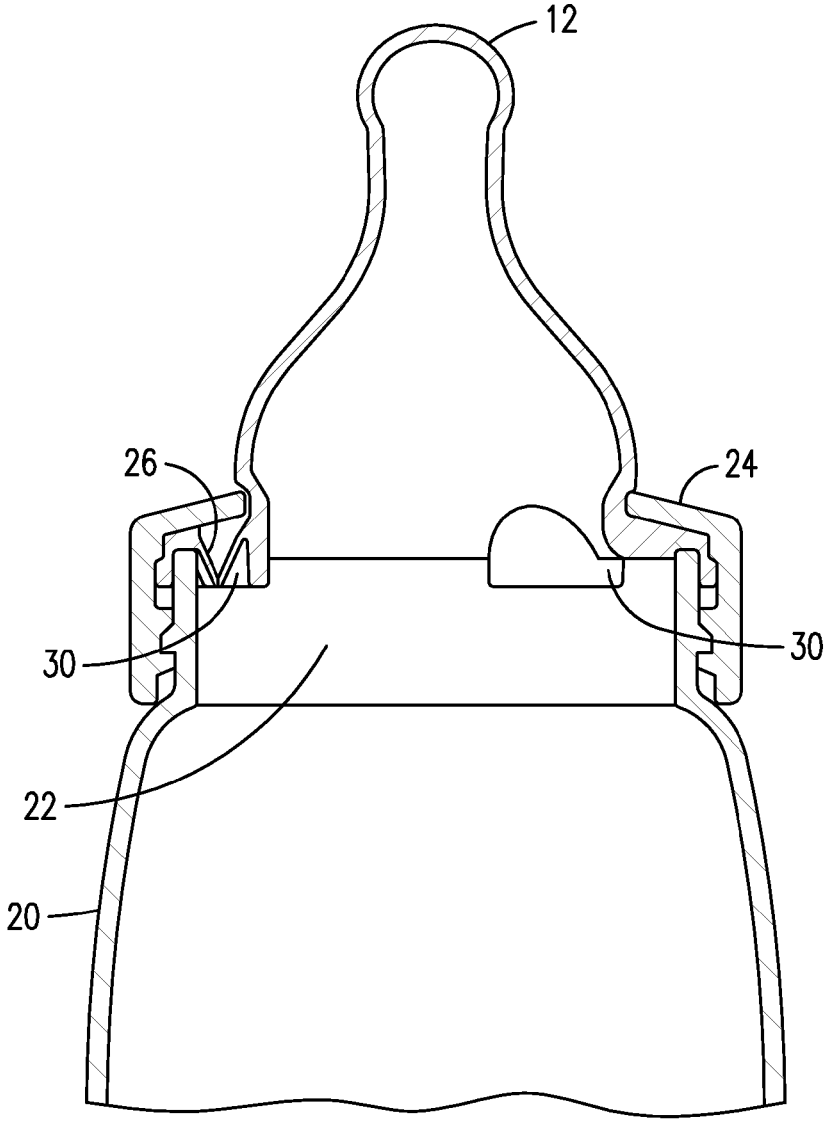
FIG. 8 is a detailed cross-sectional view similar to FIG. 5 showing the nipple operatively mounted to a bottle.

With reference to FIG. 8, the nipple 10 is intended to be mounted to a bottle 20 adjacent to a neck 22 of the bottle 20 as is known in the art such that the bottle 20 and nipple 10 together define a selectively (via flow aperture) closed vessel containing a fluid (not shown) to be fed to the infant. The nipple 10 may be attached to the neck 22 permanently, but it is preferred that the nipple 10 be a separate unit freely attachable to and detachable from the bottle 20. To this end, the mounting flange 14 may be shaped so at to provide a secure connection to the neck 22, such as by elastic constriction. It is preferred, however, that a mounting ring 24 of a type known in the art be used. The mounting ring will include a central aperture through which the teat 12 extends, with the mounting flange 14 being received between the mounting ring 24 and the neck 22. The interior of the mounting ring 24 and the exterior of the neck 22 will have appropriate mating means for securing themselves together, such a threads. The mounting ring 24 may be permanently secured to the nipple 10 by adhesive, overmolding or the like, but it is preferred that they are separate items.

As noted, the above elements, connections, and their operative use have all been known in the prior art. The inventive features shall now begin to be described.

The nipple 10 will include a plurality of vent apertures 26 extending therethough at locations which will allow communication with the interior of bottle 20 when the nipple is mounted thereto. The vent apertures are sized and shaped to substantially prevent the egress of fluid therefrom while allowing the ingress of air to the interior of the bottle 20 during use so as to reduce the negative pressure accumulating therein. The vent apertures more accurately take the form of small check valves which are normally closed, but open under the effects of negative pressure within the bottle 20. These check valves are preferably formed monolithically with the nipple 10.

The number of these vent apertures 26 provided will equal the number of flow rates provided by the flow aperture 16. If the flow aperture 16 provides two flow rates, then there will be two vent apertures. If the flow aperture 16 provides three flow rates then there shall be three vent apertures. If four flow rates, then four vent apertures, and so on. Additionally, each of the vent apertures 26 will be associated with a particular one of the flow rates, and will be located on the nipple 10 in a position so as to be vertically uppermost when the nipple 10 is operatively oriented for use of that associated flow rate.

Figure 3:
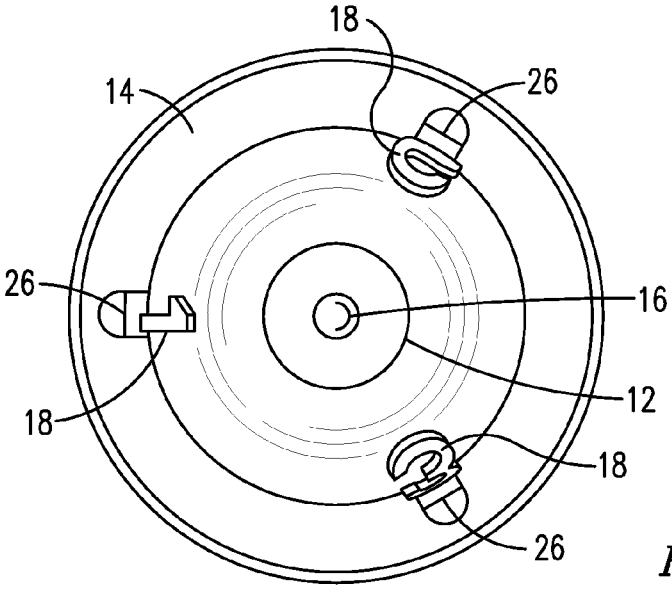
FIG. 3 is a top plan view thereof.

This is best illustrated in FIG. 3 by imagining the nipple in the operative feeding position. The flow aperture 16 includes thee flow rates associated with radial clocking positions indicated by indicia 18. In FIG. 3, nipple 10 is between clocking positions "1" and "2", and closer to "2". In use, the user would try to have the desired one of the indicia 18 truly uppermost so as to align with an imagined vertical line extending upward from the flow aperture. Each of the vent apertures 26 is similarly located to be uppermost in one of these clocking locations, as best illustrated by their placement closely adjacent associated ones of the indicia 18. This arrangement provides the nipple 10 with multiple vent apertures, each of which may operate to reduce or eliminate the negative pressure within the bottle 20. Further, and more importantly, with this arrangement there is a vent valve located uppermost at each of the flow rate clocking orientations. The orientation of a vent aperture at an uppermost position at each flow orientation is believed to provide excellent pressure reducing effects. This may be due to this vent aperture not being submerged during much of the feeding (due to reduced fluid in the bottle) or other mechanisms not understood.

As noted, each vent aperture 26 will be radially positioned near an associated one of the indicia 18. As also noted, the preferred location is to be vertically uppermost along an imagined vertical line extending from the flow aperture 16 at its associated flow rate clocking. While it is preferred to have the vent apertures positions exactly vertically aligned with each flow rate clocking, some variation is acceptable. For example, radial offset up to fifteen degrees from true vertical could be allowed, with placement within this range considered to be substantially vertically uppermost.

It is to be noted that the vent apertures 26 are shown in the figures to extend through the mounting flange 16. To allow communication with atmosphere and not be closed by the mounting ring 24, the exterior face of the nipple 10 may include a depression therein forming a vent passage 28 associated with each vent aperture 26. While this is preferred, the vent apertures 26 could alternatively (not shown) extend through the bulb portion more closely adjacent the teat 12 and completely interior of the mounting ring 24. With this arrangement, the mounting ring 24 would not block the vent apertures at all.

Figure 6:
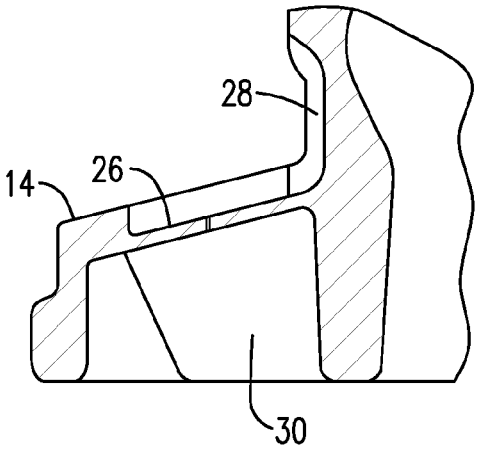
FIG. 6 is a detailed cross-sectional view similar to FIG. 5 showing a second embodiment of a venting valve.
Figure 7:
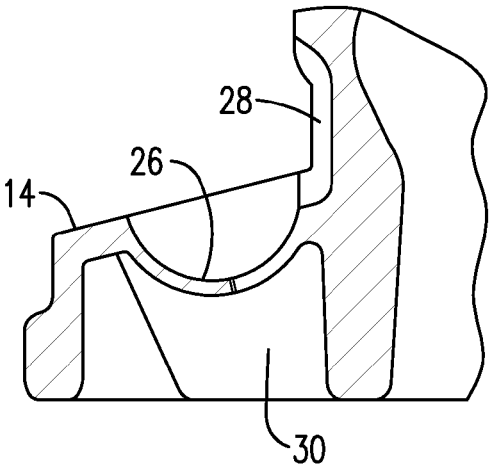
FIG. 7 is a detailed cross-sectional view similar to FIG. 5 showing a third embodiment of a venting valve.

The vent apertures 26 may take any check valve form which allows proper venting and limits spilling. In FIGS. 1-5 and 8, the vent apertures are formed as duckbill check valves known in the art and formed by a thin circular frustum of a cone transitioning to a flat segment having a line cut therethrough. Other check valve arrangements may be substituted. For example, FIG. 6 illustrates an alternative form as a reduced thickness planar area having a cut extending therethrough. Similarly, the vent aperture 26 shown in FIG. 7 is formed by a reduced thickness area having a semi-hemispherical shape with a cut therethrough. In both these alternative forms, the cuts extending through the vent apertures may be straight lines or more complex forms (such as "+", "Y", or the like).

In each case, the vent apertures play an important role by reducing negative pressure within the bottle 20 during use, but are also fragile due to their reduced thickness. It is therefore an aspect of the present invention to provide a means for protecting the vent apertures.

Figure 2:
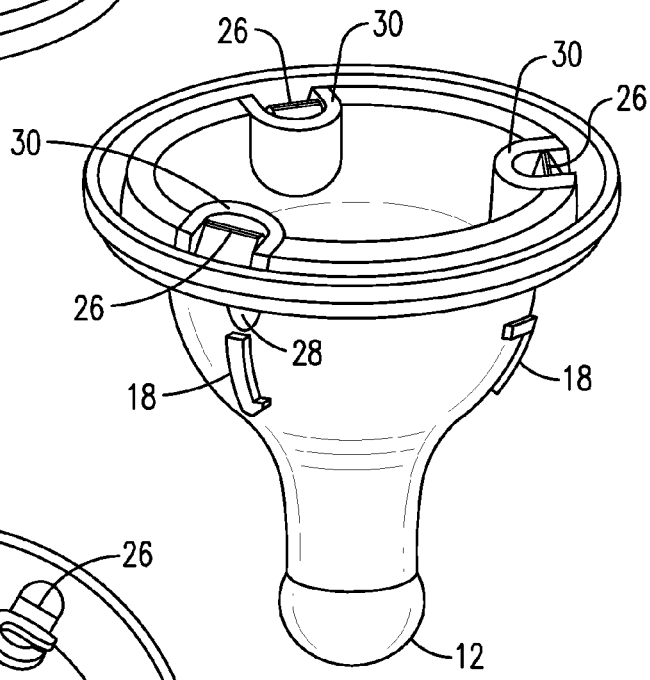
FIG. 2 is a bottom perspective view of the nipple.
Figure 4:
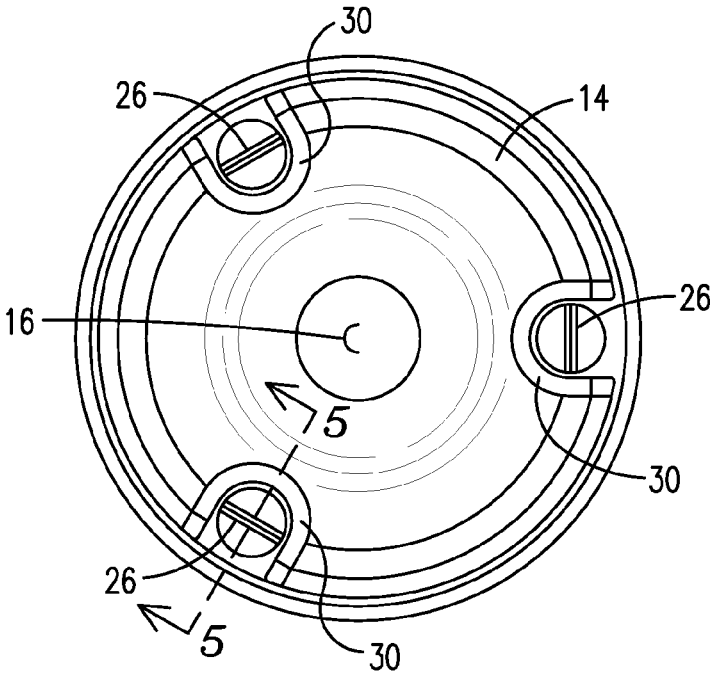
FIG. 4 is a bottom plan view thereof.
Figure 5:
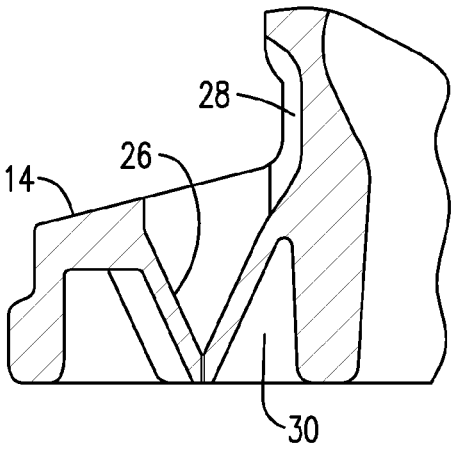
FIG. 5 is a detailed cross-sectional view a long line 5-5 of FIG. 4 showing a first embodiment of a venting valve.

As best illustrated by comparison of FIGS. 2, 4 and 5, the nipple according to the present invention includes a safety wall 30 projecting outwardly from the nipple to at least partially surround the periphery of the vent aperture 26. As shown, there will be a safety wall 30 associated with each vent aperture 26. In the embodiment illustrated, the vent apertures 26 extend downward (away from the teat) through the mounting flange 14. For this arrangement the safety walls 30 will similarly extend downward so as to protect the body of the check valve forming the vent aperture.

In the illustrated embodiment the safety walls 30 extend about approximately 180 degrees of the vent aperture periphery. This is acceptable in the illustrated embodiment since the mounting flange 14 is provided with a downward extending peripheral skirt which also serves to protect the vent aperture. Where no such skirt is provided or the vent aperture is placed radially inward toward the teat 12, the safety wall could extend about a greater portion of the vent aperture periphery, up to 360 degrees. At the other extreme, lesser extents such as thirty percent of the periphery would provide greater protection than no safety wall at all and While the safety wall could have a height slightly less than that of the check valve forming the vent aperture, it is preferred that the safety will be either of essentially the same height (as illustrated) or slightly longer. As with the check valves, the safety walls 30 are preferably formed as monolithic extensions of the nipple 10.

As may be envisioned, the safety walls 30 will protect the associated check valves forming the vent apertures 26 by preventing or reducing contact with the check valve. This contact would typically take place during cleaning. The safety walls 30 are preferably not so long as to prevent access to the check valve for cleaning, but rather limit or eliminate inadvertent (and overly forceful) contact while permitting more deliberate and gentle cleaning contact.

From the foregoing it will be seen that this invention is one well adapted to attain all ends and objects set forth above together with the other advantages which are inherent within its structure.

It will be understood that certain features and subcombinations are of utility and may be employed without reference to other features and subcombinations. This is contemplated by and is within the scope of the claims.

Since many possible embodiments may be made of the invention without departing from the scope thereof, it is to be understood that all matter herein set forth of shown in the accompanying drawings is to be interpreted as illustrative, and not in a limiting sense.

What is claimed is:

1. An infant feeding nipple, comprising:

a teat sized and shaped for receipt in an infant's mouth;

a mounting flange extending outward from said teat;

a flow aperture extending through said teat and providing at least two flow rates depending upon the radial clocking of said nipple during feeding; and a plurality of vent apertures formed by check valves extending thorough said nipple to reduce negative pressure during use, the number of said vent apertures matching the number of said flow rates, and wherein each of said vent apertures is associated with a particular one of said flow rates, and is radially positioned about said nipple so as to be substantially vertically above said flow aperture when said nipple is oriented with radial clocking for said associated flow rate, and, wherein all vent apertures will be operable at once to allow communication with atmosphere and not be closed by mounting ring.

2. A nipple as in claim 1, wherein the number of said flow rates and of said vent apertures is three.

3. A nipple as in claim 1, wherein in said vent apertures extend through said mounting flange.

4. A nipple as in claim 3, wherein vent apertures are formed as duckbill check valves.

5. A nipple as in claim 4, wherein the number of said flow rates and of said vent apertures is three.

6. A nipple as in claim 1, further including a safety wall extending outward from said nipple about at least half of the periphery of each said vent aperture, said safety wall having a height at least substantially similar to that of said check valve forming said vent aperture.

7. A nipple as in claim 6, wherein said vent apertures extend though said mounting flange.

8. An infant feeding nipple, comprising:

a teat sized and shaped for receipt in an infant's mouth;

a mounting flange extending outward from said teat;

a flow aperture extending through said teat;

at least one vent aperture formed by a check valve extending thorough said nipple to reduce negative pressure during use; and a safety wall extending outward from said nipple about at least half of the periphery of each said vent aperture, said safety wall having a height at least substantially similar to that of said check valve forming said vent aperture.

9. A nipple as in claim 6, wherein said vent apertures extend though said mounting flange.

* * * * *